US005953821A

United States Patent [19]

Mearns

[11] Patent Number: 5,953,821

[45] Date of Patent: Sep. 21, 1999

[54] FOLDING TOOL, SUCH AS FOLDABLE KNIFE

[76] Inventor: Steve G. Mearns, Nieuwe Tuinstraat 2', NL-1015 ZR Amsterdam, Netherlands

[21] Appl. No.: 08/900,093

[22] Filed: Jul. 25, 1997

[51] Int. Cl.[6] ..... B26B 1/04

[52] U.S. Cl. ..... 30/161; 30/155

[58] Field of Search ..... 30/155, 160, 161, 30/340, 342, 344

[56] References Cited

U.S. PATENT DOCUMENTS

| | | | |
|---|---|---|---|
| 557,818 | 4/1896 | Hotchkiss | 30/161 |
| 701,686 | 6/1902 | Day | 30/161 |
| 971,057 | 9/1910 | Luce | 30/161 |
| 1,397,018 | 11/1921 | Priestman | 30/155 |
| 4,066,514 | 1/1978 | Penman | 30/161 |
| 4,083,110 | 4/1978 | Goldin et al. | 30/155 |
| 4,536,959 | 8/1985 | Ross | 30/161 |
| 4,730,394 | 3/1988 | Sonner, Jr. | 30/161 |
| 4,947,551 | 8/1990 | Deisch | 30/161 |

FOREIGN PATENT DOCUMENTS

| | | | |
|---|---|---|---|
| 95799 | 4/1897 | Germany | 30/161 |
| 100 224 | 4/1912 | Germany | 30/161 |

*Primary Examiner*—Hwei-Siu Payer
*Attorney, Agent, or Firm*—Bachman & LaPointe, P.C.

[57] ABSTRACT

A folding tool including a U-shaped handle and a tool element adapted to lie within the handle in its closed position, a tang at one end of the tool element fitted pivotally around a pivot axis between the two prongs of the handle, said pivot axis extending parallel to the plane defined by the tool element, wherein a locking leg extending parallel to the prongs is resiliently suspended on the inner side of the first prong such that a free end of the leg can be pressed towards the first prong against the action of a spring force. The locking leg is provided with locking means adapted to engage with an engagement part of the tang for locking the tool in its 180° opened position, the locking state being disengaged by pushing the free end of the locking leg towards the first prong.

19 Claims, 3 Drawing Sheets

FOLDING TOOL, SUCH AS FOLDABLE KNIFE

BACKGROUND OF THE INVENTION

This invention relates to a folding tool comprising a U-shaped handle and a flat tool element adapted to lie within the handle in its closed position and being pivotable around an axis into an open position. The pivot axis extends parallel to the plane spaned by the flat tool element and between the prongs of the handle.

Such folding tools, especially in the form of foldable bladed knifes, are generally known, see for example U.S. Pat. Nos. 4,083,110 and 1,397,018. For locking the bladed knife in its open position, the U-shaped handle is fabricated from resilient materiel, such that a spring force resulting from the resilient material must be overcome on order to increase the distance between the prong ends. As will be clear, such a spring fore can be used to provide a locking engagement between the prongs and the tang ot the knife blade. According to U.S. Pat. No. 1,397,018 said locking engagement ia possible by employing a handle with an internal rounded or U-shaped groove in which the tang edges can engage. Such a locking mechanism is also used in U.S. Pat. No. 4,083,110, see especially FIG. 3.

One of the problems encountered with such foldable bladed knifes is that the prong ends must be pushed away from each other in order to disengage the locking and to be able to bring the bladed knife back into its closed position. This is difficult, if not impossible, to accomplish with one hand.

SUMMARY OF THE INVENTION

Briefly described the invention is concerned with a folding tool of the type comprising a U-shaped handle and a tool element adapted to lie within the handle in its closed position, a tang at one end of the tool element being fitted pivotably around a pivot axis between the two prongs of the handle, which pivot axis extends parallel to the plane defined by the essentially flat tool element.

One object of this invention is to provide an improved folding tool of the aforementioned type.

A further object of this invention is to provide a folding tool of the aforementioned type which can be operated easily by one hand.

Another object of this invention is to provide a folding tool, which is inexpensive to construct and manufacture.

A still further object of this invention is to provide a folding knife with a U-shaped handle and an essentially flat knife blade.

A further object of the invention is to provide a folding tool having a reliable locking mechanism, of which the locking force can, if necessary, be increased by means of the operating hand.

A folding tool which is especially easily to operate by one hand is according to the invention obtained by providing a locking leg extending parallel to the prongs, which locking leg is resiliently suspended on the inner side of the first prong such that a free end of said leg can be pressed towards said first prong against the action of a spring force, and in which said leg is provided with locking means adapted to engage with an engagement part of the tang for looking the tool in its 180° open position, the locking state being disengageable by pushing the free end of the locking leg towards said first prong. The locking leg can easily be manipulated by means of a finger of the hand gripping or enclosing the U-shaped handle. The locking leg can be manipulated even without loosening the grip on the U-shaped handle. If the U-shaped handle is gripped very tightly, for example the prongs of the U-shaped handle being pressed towards each other, this will possibly increase the force needed for disengaging the locking state, but it will not make the disengaging impossible because the locking leg is virtually independent from the prongs by means of its suspension.

A locking mechanism which is reliable in function, and easily to construct, is obtained by providing the locking leg with an elongated slit facing the second prong. The elongated slit can take up or enclose a side edge of the tang of the tool element. This elongated slit can in the same manner also provide fog a locking in the closed position, in which case the elongated slit will take up a part of the tool element.

By providing a bladed knife as the tool element, a very functional foldable bladed knife is obtained according to the invention.

A foldable bladed knife, which is easy and safe to use, is according to the invention obtained if the tool element is a bladed knife having a blade with at least one longitudinal cutting edge at the side of the second prong. In use, the thumb of the hand gripping the unfolded foldable knife is resting on the upper or first prong. To disengage the locking mechanism of the bladed knife, it is only necessary to squeeze between the thumb and a further finger, for example the index finger, the first prong and the free end of the locking leg. If desired also at the side of the first prong a cutting edge can be provided so that a double edged cutting blade is obtained.

A very advantageous guillotine effect is obtained if the longitudinal backside edge of the tool element comprises a straight part extending from the rotational axis in the direction away from the tang, and if the locking leg is provided with a complementary straight part which during closing and/or in the closed position snugly fits with the straight part of the tool element, and if the straight part of the tool element is sharp-edged to provide a guillotine action. This sharp-edged feature could also be obtained by a cutting edge, or example if a double edged cutting blade is used.

In order to improve the locking mechanism, it is further advantageous if the locking leg is biased in the direction of the second prong, such that in the locking state the engagement between the locking leg and the tang of the tool element is more solid and firm.

In order to be able to further improve the engagement and locking between the locking leg and the tang, it is according to the invention very advantageous if a slide is guided and arranged on the first prong near the free end of the locking leg, said slide being slidable along the first prong from a first to a second position and vice versa, in the first position the slide being arranged in the interspace between the locking leg and first prong to hinder the pressing of the locking leg towards the first prong, in the second position the slide being arranged on a place, for example outside said interspace, allowing said pressing. With such an embodiment, the slide can be moved to its first position, after which the engagement and locking can be improved by squeezing the prongs of the handle by means of the hand in which the handle is held. By means of the slide it is assured that the squeezing action on the prongs is transferred to the locking leg and thus is utilized for improving the locking and engagement between the locking leg and the tang. This slide also restricts sideways movement of the locking leg. Also other means are conceivable for improving the engagement and locking by arranging a distance member in the interspace between the locking leg and the first prong.

In order to reduce the manufacturing costs it is according to the invention advantageous if the locking leg is formed by folding back an elongation of the first prong. In this manner the locking leg and the handle can be made out of one piece of preferably a resilient material.

The resistance against bending moments exerted on the knife blade or flat tool element and thus also the locking of the locking mechanism is further improved if the rotational axis is arranged near the outer ends of the prongs and at a distance from the free outer end of the tang. By increasing the distance between the free outer end of the tang and the rotational axis, resistance to the bending moment is increased.

In order to increase the efficiency of use, it is according to the invention advantageous if the rotational axis is arranged at a distance from the free outer end of the tang, such that in the closed position the tang projects from the handle. By this it becomes possible to open the folding tool by pushing the projected tang against a further object, such as a table top, a stone, a leg, etc.

A simple, effective and reliable locking mechanism is obtained if said part of the tang for locking the tool in its 180° opened position is arranged on the side of the tang facing the first prong and is provided with a first engagement edge for engagement with the locking means, said locking means being provided with a complementary shaped second engagement edge. In this way a locking having a so-called positive fit is obtained. Advantageously thc second engagement edge is arranged at or near the free end of the locking leg. According to a special embodiment the second engagement edge can be formed by the end face of the free end of the locking leg.

An advantageous positive fit is to be obtained if said part of the tang is multi-lateral, preferably square, and centered around the pivot axes. This provides the possibility to lock the tool element in intermediate positions between its closed and 180° opened position. In case of a square part, there is provided a locking possibility in a 90° opened position.

According to a further preferred embodiment the positive fit is improved if said part of the tang is multi-lateral, preferably square. and if the locking means comprise a cutout, the enclosing inner edge of which forms the complementary shaped second engagement edge.

Other objects, features and advantages of the present invention will become apparent upon reading the following specification, when taken in conjunction with the accompanying drawings. These drawings show some preferred embodiments.

DESCRIPTION OF SOME PREFERRED EMBODIMENTS

Throughout the several figures alike parts are indicated by alike reference signs.

Figure 1:
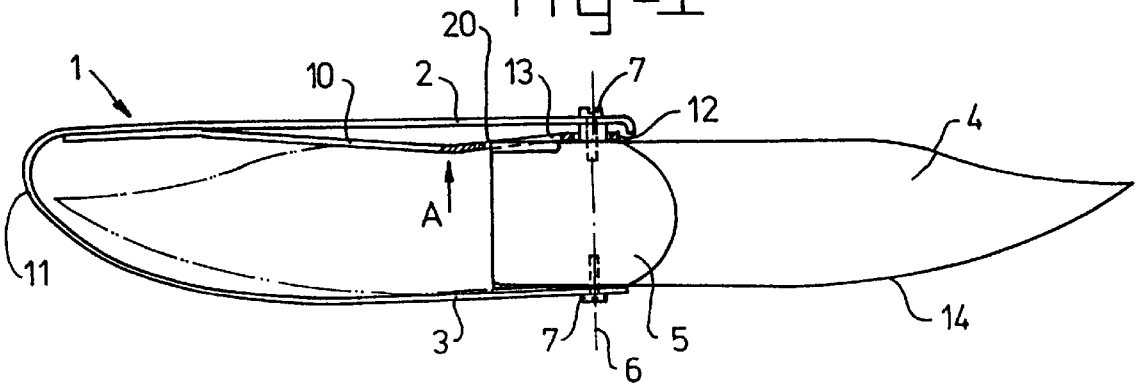
FIG. 1 is a schematic side view of a foldable knife according to the invention, showing the blade of the knife in its 180° opened position.
Figure 2:
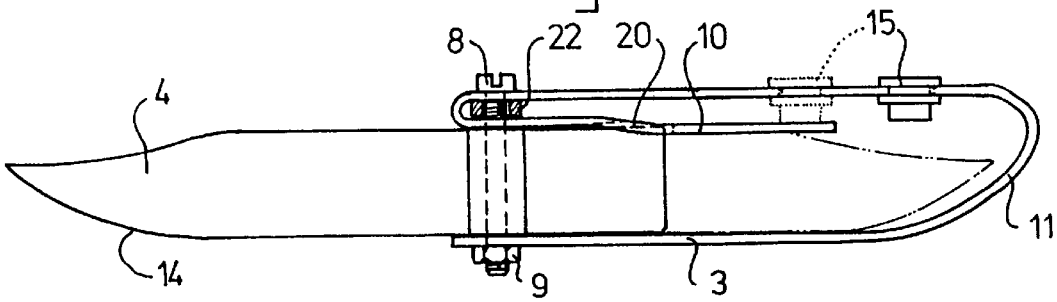
FIG. 2 is a schematic side view of a second embodiment of a foldable knife according to the invention, showing the blade or the knife in its 180° opened position.
Figure 3:
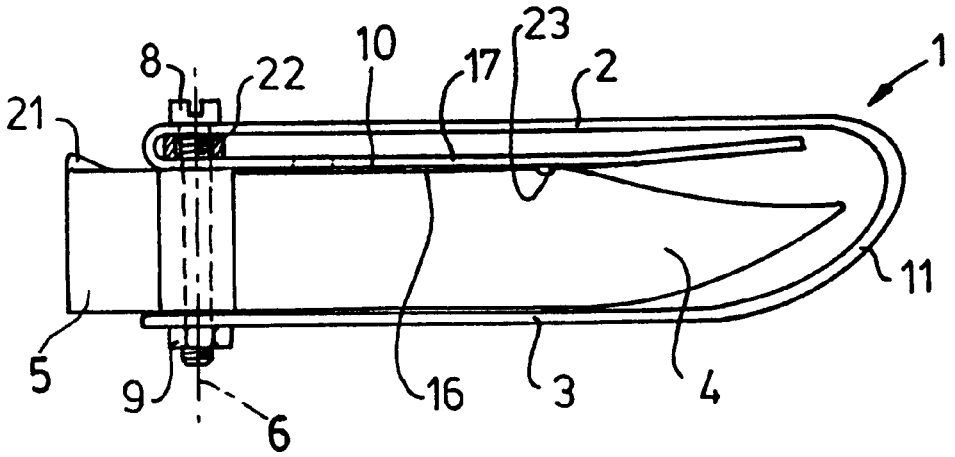
FIG. 3 is a schematic side view of still a further embodiment of a foldable knife according to the invention, showing the blade of the knife in its closed position.

FIG. 1 illustrates a first embodiment of a folding tool, in casu a foldable knife, according to the invention. The tool comprises a U-shaped handle 1 having two prongs 2 and 3. An essentially flat tool element, in casu a bladed knife 4, is adapted to lie within the handle 1 in its closed position, as is indicated by dashed dotted lines. At one end of the bladed knife 4 is provided a tang 5. This tang 5 is fitted pivotally around a pivot axis 6 between the two prongs 2, 3 of the handle 1. The pivot axis 6 extends parallel to the plane defined by the bladed knife 4, in this case extends through the plane defined or spanned by the bladed knife 4. The pivotally fitting of the tang between the two prongs of the hand1e is realized by means of two pivot pins 7. Those pivot pins 7 are in the form of screws. Referring to FIGS. 2 and 3 it will, however, be clear that the pivot pin can also be provided in a different way, for example by means of a screw bolt 8 with a nut 9, or rivet (not shown).

As far as described up to now with respect to the drawings the folding tool does not essentially differ from folding tools, especially foldable knives, known from the prior art.

According to the invention the folding tool is provided with a locking leg 10. In the embodiment according to FIG. 1 the locking leg 10 is fixed, for example welded or riveted, to the first or upper prong 2 near its base side 11 opposite its free end. The locking leg 10 is made of a resilient material, such that when it is pressed upwardly (arrow A) towards or against the upper prong a resilient reactive force is introduced. Near its free end 12 the locking leg 10 is provided with an aperture through which the upper pivot pin 7 essentially freely extends. On its side opposing the lower or second prong 3 the locking leg 10 is provided with locking means in the form of a slanting part 20 having an elongated slit 13, which in this case in fact is a throughgoing slit which is also open on the upper side of the locking leg 10 facing towards the upper prong 2. As will be clear from FIG. 1, the knife blade 4 can be brought in a locking state, in which the upper backside of the tang 5 is engaged within the elongated slit 13. It will also be clear that by pressing the locking leg 10 upwardly, as is indicated by arrow A, in the direction of the upper prong 2, the locking state will be disengaged, so that the knife blade 4 can be rotated over 180° back to its closed state, indicated by dashed dotted lines. By making the part 20 of the locking leg 10 slanting or angled and having the upper side of the tang 5 essentially straight, a guiding effect is obtained, which helps to bring the knife blade in its locking state. A similar guiding affect can of course be obtained by providing the tang with a slanting protrusion 21 and having the locking leg 10 essentially straight (see FIG. 3) or by providing both the tang and the locking leg with a slanting part.

On its lower side the knife blade 4 is provided with an ordinary longitudinal cutting edge 14 lying at the side of the second or lower prong 3. During use the hand of a user will enclose the handle 1 and the thumb of the user will, at least when cutting, normally rest on the upper prong 2 near the pivot pin 7. In order to disengage the locking state it suffices to push with the index finger against the underside of the locking leg 10 in the direction of the arrow A. As will be clear this can be done with one and the same hand holding the knife during use and essentially without altering the grip of the knife. The same index finger can after disengaging the locking mechanism be used to push against the backside of the tang 5 in order to rotate the knife blade 4 out of its 180° opened position. Next the knife blade 4 can easily be turned further to its closed position, in which the knife blade 4 lies within the handle 1, in which contact with the cutting edge 14 is prohibited.

In order to lock the knife blade in its closed state (the dashed dotted lines), one can make use of the same principle as is used for the locking in its 180° opened position. For this purpose the same slit 13 or a further slit (not shown) can be used.

FIGS. 2 and 3 show two further embodiments, which especially differ by the shape of the locking leg 10. The locking legs 10 according to FIGS. 2 and 3 are formed by folding back an elongation of the first or upper prong 2. This will be clear from the Figures. This provides the possibility to manufacture the handle 1 and locking leg 10 out of one piece of for example a resilient metal. A spacer element 22 can be arranged between the prong and locking leg near the place of the folding back.

FIG. 2 further shows a slide 15 being slidably arranged on the upper prong 2. The slide 15 can upon manipulation by means of a finger slide from a first position (dotted lines) to second position (solid lines) and vice versa. In the first position, the slide lies in the interspace between the locking leg and first prong and can, if desired, contact both, so that pressing of the locking leg towards the first prong (in the direction of arrow A) is prohibited. In this first position the locking engagement between the locking leg 10 and the upper backside of the tang 5 is increased and can further be increased by squeezing the upper prong 2 and lower prong 3 between the one hand gripping the tool during use. In order to be able to disengage the locking state, first the slide 15 has to be moved to its second position, then the locking leg 10 can be pushed upwardly and the knife 4 can be rotated back to its closed position. Also other means are conceivable for improving the engagement and locking by arranging a distance member in the interspace between the locking leg and the first prong.

FIG. 3 shows a third embodiment of a foldable knife according to the invention in its closed state. The free outer end of the tang 5 projects in this closed state from the handle, such that the knife blade can easily be rotated by striking or pressing with said projecting free outer end against an object, such as a table or a rock.

Further referring to FIG. 3, the third embodiment shows a knife blade 4 with a longitudinal backside edge comprising a straight part 16 extending from the rotational axis 6 in the direction away from the tang 5. The locking leg 10 is provided with a complementary straight part. As shown in FIG. 3 the straight parts 16 and 17 snugly fit with each other, when the tool is in its closed state or closed position. Further the straight part 16 of the knife blade 4 is essentially sharp-edged. With the term "sharp-edged" is meant that this edge 16 is essentially not rounded but has sharp corner edges, so that when the knife blade 4 is brought into its closed position there is provided a guillotine effect between the straight part 16 and the straight part 17 enabling to cut through for example a piece of paper It will be clear that this also provides for the possibility to cut through a rope, a cable, etc. For cutting through a rope or cable there could further be provided a small cutout or recess in the locking leg 10 in which the cable or rope can be accommodated during the closing of the knife blade 4 so that its position is fixed during the cutting through.

Further referring to FIG. 3, this embodiment shows an alternative for the locking of the knife blade into its closed position. The locking leg 10 io provided with two protruding bulges 23 (only one of them is to be seen) between which the knife blade is enclosed in its closed position.

Figure 4:
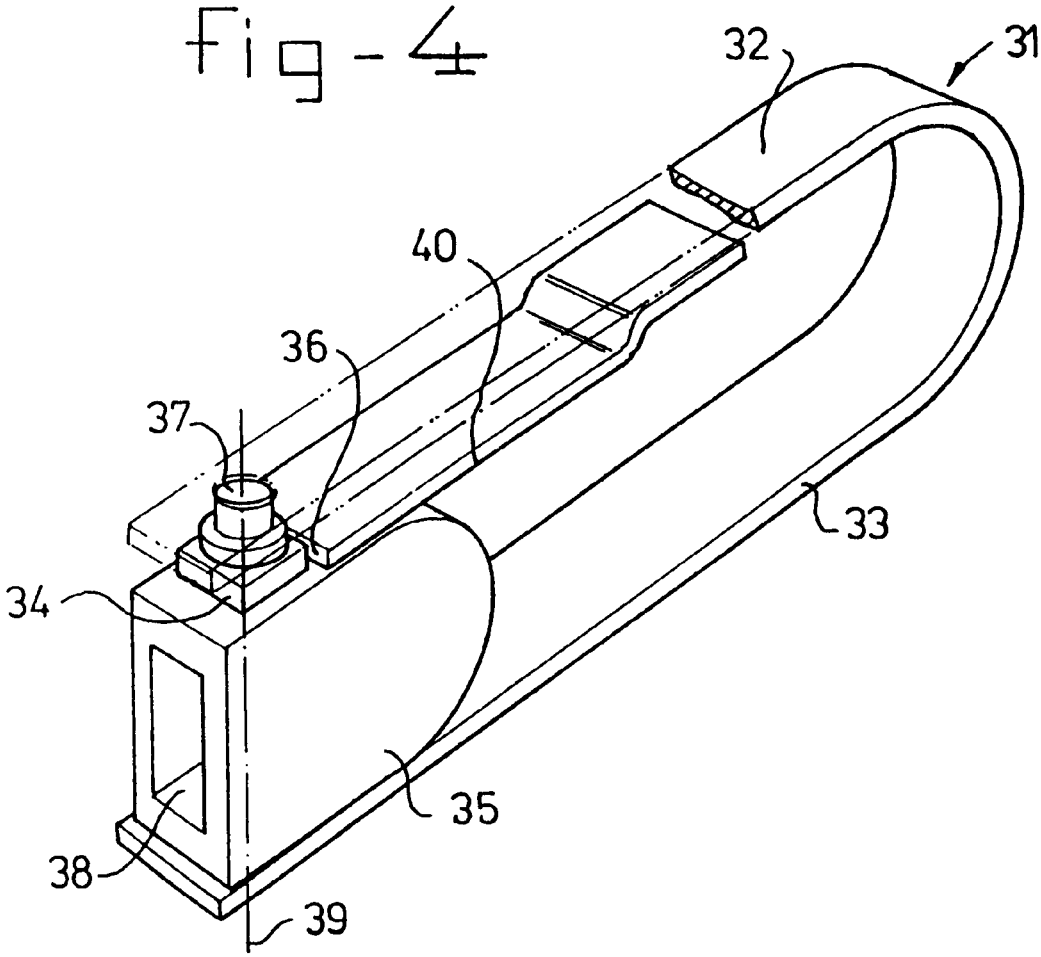
FIGS. 4 and 4A are schematic perspective views of still further embodiments of a folding tool according to the invention, in which the tool element (not shown) is exchangeable.

FIG. 4 shows a schematic perspective view of a folding tool according to the invention. This folding tool comprises a U-shaped handle 31 having an upper prong 32 end a lower prong 33 and a locking leg 40 which is mounted on the upper prong 32 in a manner alike the locking leg 10 of the embodiment according to FIG. 1. Between the ends of the prongs 32 and 33 extends a pivot axis 39 around which the tang 35 is rotatable by means of pivot pins 37. The upper pivot pin 37 is at its base provided with a multi-lateral part, in this case a square part 34. This square part 34 in fixed relative to the tang 35 and centered on the pivot axis 39. At its free end the locking leg 40 is provided with an engagement edge, the so-called second engagement edge. The first engagement edge is formed by the vertical sides of the square part 34. The second engagement edge 36 is essentially complementary shaped with each side of the square part 34. It will be clear from FIG. 4 that in case of engagement between engagement edge 36 and one of the sides of engagement edge 34 a so-called positive fit is obtained. This positive fit can be disengaged by pressing the locking leg 40 in the direction of the upper prong 32. Upon this disengagement of the positive fit, the tang 35 can be rotated to its desired position. It will be clear that by virtue of the square part 34 a positive fit is possible after each time the tang 35 is rotated over 90°. By making the multi-lateral part 34 for example hexagonal more locking positions are obtained, in this case one locking position for each 60° of rotation.

Figure 4A:
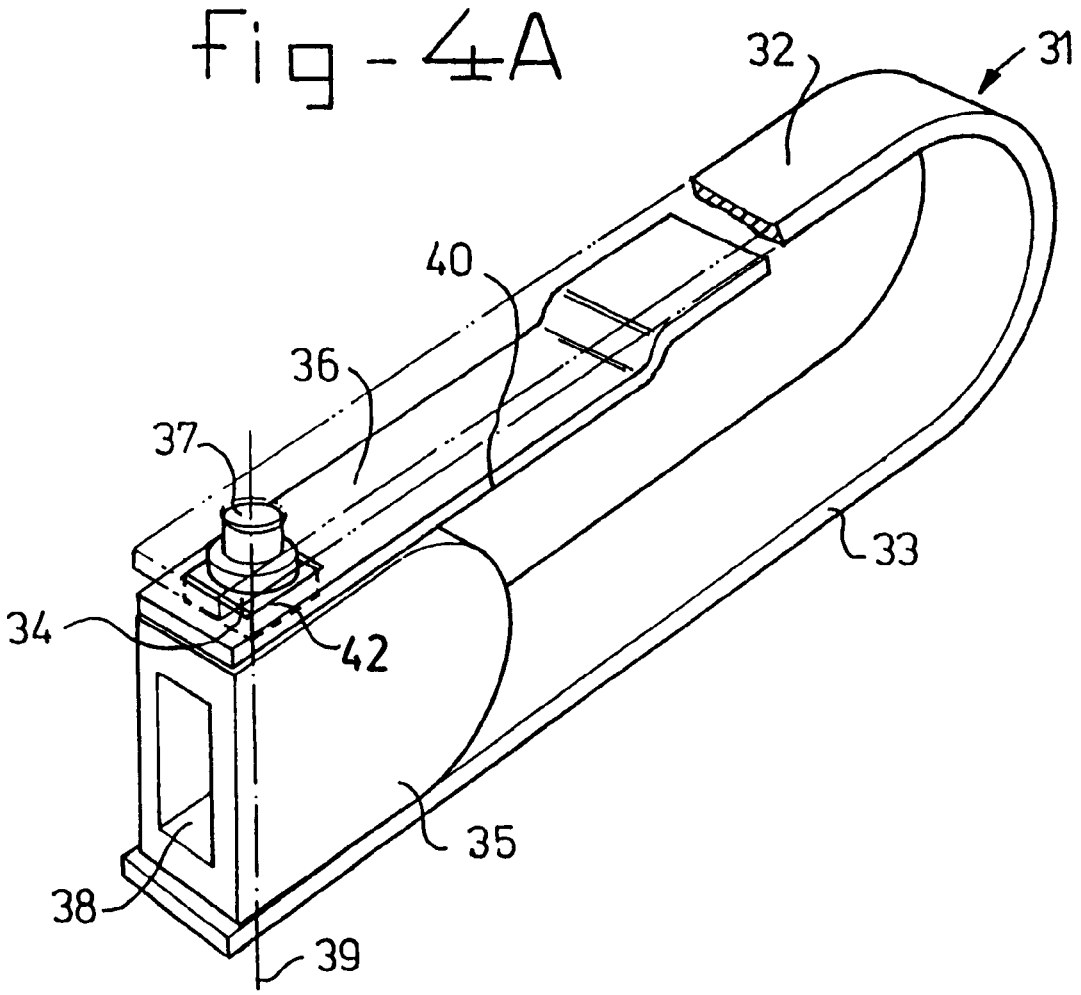

The tang 35 of the embodiment according to FIG. 4 is provided with a cavity 38 in which a tool element can be slid. This so-called slotting connection between the tang 35 and the tool element (not shown in FIG. 4) provides for an easy manner to interchange between different tool elements. In such a case there will be provided for a non-permanent fixation between the tool element and the tang 35. It will also be possible to provide for a permanent fixation between the tool element and the tang 35, in which case the embodiment according to FIG. 4 still provided the advantage that many different kinds of foldable tools can be manufactured with a minimum of standard parts. FIG. 4A is similar to FIG. 4 wherein the locking means comprise a cutout 42 formed in the locking leg 40, the enclosing inner edge of which forms the complementary shaped second engagement edge.

While the invention has been described in detail with particular reference to three preferred embodiments thereof, it will be understood that variations and modifications can be effected within the spirit and scope of the invention as described herein before and as defined in the appended claims.

For example it will be clear that if in its closed position the tang extends beyond the ends of the prongs, said extending part of the tang can be provided with a further tool, such as for example a screw driver blade, a bottle opener, a can or tin opener, a cross-head screw driver tip, etc. The so-called guillotine effect can of course also be obtained between the sharp knife side of a knife blade and the neighbouring prong as well as between the tang and one or both prongs. Further the tool element can be pivoted in two directions. It will also be clear that the handle can be provided with extra features, such as a wooden or plastic grip part. Even if the handle and prongs are made very stiff, a good functioning of the folding tool according to the invention is still possible by virtue ot the separate locking leg.

I claim:

1. A folding tool comprising a U-shaped handle and a tool element adapted to lie within the handle in its closed position, a tang at one end of the tool element being fitted pivotably around a pivot axis between a first prong and a second prong of the handle, said pivot axis extending parallel to the plane defined by the tool element, wherein a locking leg extending parallel to the prongs is resiliently suspended on the inner side of the first prong such that a free end of said leg can be pressed towards said first prong against the action of a spring force, said locking leg being provided with locking means adapted to engage with an engagement part of the tang for locking the tool in its 180° opened position, the locking state being disengageable by pushing the free end of the locking leg towards said first prong.

2. The tool of claim 1, wherein the locking means comprise an elongated slit formed in the locking leg and facing the second prong.

3. The tool of claim 1, wherein the tool element is a bladed knife.

4. The tool of claim 1, wherein the tool element is a bladed knife having a blade with one longitudinal cutting edge facing the second prong.

5. The tool of claim 1, wherein the longitudinal backside edge of the tool element comprises a straight part extending from the pivot axis in the direction away from the tang, and wherein the locking leg is provided with a complementary straight part which during closing snugly fits with the straight part of the tool element, said straight part of the tool element being sharp-edged to provide a guillotine action.

6. The tool of claim 1, wherein the locking leg is biased in the direction of the second prong.

7. The tool of claim 1, wherein a slide is guided and arranged on the first prong gear the free end of the locking leg, said slide being slidable along the first prong from a first to a second position and vice versa, in the first position the slide being arranged in the interspace between the locking leg and first prong to hinder the pressing of the locking leg towards the first prong, in the second position the slide being arranged outside said interspace allowing said pressing.

8. The tool of claim 1, wherein the locking leg is formed by folding back an elongation of the first prong.

9. The tool of claim 1, wherein the pivot axis is arranged near the outer ends of the prongs and at a distance from the free outer end of the tang.

10. The tool of claim 1, wherein the pivot axis is arranged at a distance from the free outer end of the tang, such that in the closed position the tang projects from the handle.

11. The tool of claim 10, wherein on the one hand the upper and/or lower edge of the tang and on the other hand that part of the respective neighbouring prong extending between the pivot axis and the free outer end of the prong are shaped such that during rotation of the tool element a guillotine or plier action is provided therebetween.

12. The tool of claim 1, wherein said part of the tang for locking the tool in its 180° opened position is arranged on the side of the tang facing the first prong and is provided with a first engagement edge for engagement with the locking means, said locking means being provided with a complementary shaped second engagement edge.

13. The tool of claim 12, wherein the second engagement edge is arranged at the free end of the locking leg.

14. The tool of c1aim 12, wherein the second engagement edge is formed by the end face of the free end of the locking leg.

15. The tool of claim 12, wherein said part of the tang is multi-lateral and centered around the pivot axis.

16. The tool of claim 15, wherein said part of the tang is square.

17. The tool of claim 12, wherein said part of the tang is multi-lateral and wherein the locking means comprise a cutout, the enclosing inner edge of which forms the complementary shaped second engagement edge.

18. The tool of claim 17, wherein said part of the tang is square.

19. The tool of claim 1, wherein the tang is provided with a slot in which the tool element is slotted in a releasable manner.

* * * * *

UNITED STATES PATENT AND TRADEMARK OFFICE

CERTIFICATE OF CORRECTION

PATENT : 5,953,821

DATED : September 21, 1999

INVENTOR(S) : Steve G. Mearns

It is certified that error appears in the above-identified patent and that said Letters Patent is hereby corrected as shown below:

Column 1, line 16, "materiel" should read --material--;
line 17, "on" should read --in--;
line 19, "fore" should read --force--;
line 20, "ot" should read --of--;
line 22, "ia" should read --is;
line 63, "looking" should read --locking--;
Column 2, line 15, "fog" should read --for--.
Column 3, line 31, "thc" should read --the--.
Column 4, line 18, "handle" should read --handle--
Column 6, line 1, "io" should read --is--;
line 6, "end" should read --and--;
line 13, "in" should read --is--.
Column 7, line 35, "gear" should read --near--.
Column 8, line 25, "claim" should read --claim--.

Signed and Sealed this

Twenty-fifth Day of April, 2000

*Attest:*

Q. TODD DICKINSON

*Attesting Officer*

*Director of Patents and Trademarks*